US007128702B2

(12) United States Patent
Boland et al.

(10) Patent No.: US 7,128,702 B2
(45) Date of Patent: Oct. 31, 2006

(54) AB VOLLEY

(76) Inventors: Kevin O. Boland, 5623 Massachusetts Ave., Bethesda, MD (US) 20816; Cornell S. Marschalko, 941 Saigon Rd., McLean, VA (US) 22102

( * ) Notice: Subject to any disclaimer, the term of this patent is extended or adjusted under 35 U.S.C. 154(b) by 86 days.

(21) Appl. No.: 10/972,370

(22) Filed: Oct. 26, 2004

(65) Prior Publication Data

US 2006/0089242 A1 Apr. 27, 2006

(51) Int. Cl.
*A63B 26/00* (2006.01)

(52) U.S. Cl. ..... 482/142

(58) Field of Classification Search ..... 482/142, 482/148; D21/676, 689, 690, 662, 698, 781, D21/811; 273/1.5 R, 317, 317.3
See application file for complete search history.

(56) References Cited

U.S. PATENT DOCUMENTS

2005/0266972 A1* 12/2005 Shifferaw ..... 482/142

* cited by examiner

*Primary Examiner*—Lori Amerson
(74) *Attorney, Agent, or Firm*—Zito tlp; Joseph J. Zito; Kendal M. Sheets

(57) ABSTRACT

An exercise machine designed to exercise the upper body, focusing particularly on the core abdominal muscles but also on the arms, shoulders and chest. The machine comprises a structural frame with an adjustable seating mechanism, a handlebar and one or more position-adjustable targets against which a user throws a weighted ball. The machine provides two modes of exercise. In the seated mode the user exercises the abdominal muscles by rocking the body while seated in the flexible, adjustable-resistance, back-supported seating mechanism. The back support element of the seating mechanism is adjustable into a flat position, effectively converting the seat into a bench. In bench mode, the user, laying face up on the bench and holding onto the handlebar for stability, exercises the lower abs by performing leg-raising crunches. The machine is designed to be uniquely stimulating and fun to use. It may be folded compactly for storage.

20 Claims, 17 Drawing Sheets

AB VOLLEY

FIELD OF THE INVENTION

The present invention relates to exercise machines which use a form of resistance to exercise specific muscle groups of the body. More specifically, the present invention is a total abdominal exercise machine employing a weighted exercise ball thrown by a user against an adjustable-position ball return mechanism.

BACKGROUND OF THE INVENTION

There is an ever increasing demand for abdominal exercise machines. It is currently the most sought after area of the human body to trim, tone and tighten. There are many varieties of abdominal exercise machines on the market. Some target a specific abdominal area, such as the main abs, or the obliques. Some provide for a more comprehensive workout, targeting multiple areas.

Generally, the majority of the exercise machines which work the abs are weight or resistance based. Most of these are designed as simple, repetitive motion machines, allowing the user little stimulation beyond that of the body part being exercised. That is, the exercise does not involve the user on any but a purely mechanical level. It does not engage any of the user's other abilities or interests during the routine. It is not fun.

An exercise that is fun is more likely to be performed. This, of course will be better for the user. Thus there exists a commercial opportunity in the field of this invention for an exercise machine which tones and strengthens the total abdominal muscle group and is fun to use.

One engaging activity that is relatively fun to do is that of tossing a ball against a surface which returns it back to you. This requires concentration on the part of the person performing the activity, especially if some degree of aim is involved, and once a rhythm is established, the successful repetition tends to entice the person to continue. If this activity can be incorporated into an exercise regimen, a sporty, fun way to exercise may be achieved.

U.S. Pat. No. 6,280,367 by Christopher Arsenault discloses a machine designed for exercising the abs which utilizes a ball thrown at a target. Arsenault's machine appears to be limited in its variability, having little range of physical adjustment. Adjustment to the position of operative components of an exercise machine varies the user's motion during a routine. This is important in muscle conditioning since a variation in the direction of force applied to a muscle during successive routines will help that muscle more fully develop.

Thus there remains a potential to develop an exercise machine which produces a benefit for the total abdominal muscle group, provides a significant range of adjustment for the interactive components and is engaging and fun to use.

SUMMARY OF THE INVENTION

An exercise machine is disclosed which is designed to exercise the upper body, focusing particularly on the core abdominal muscles but also on the arms, shoulders and chest. The machine comprises the primary components of a structural frame with an adjustable seating mechanism, a handlebar and one or more position-adjustable targets against which a user throws a weighted ball.

The machine provides two modes of exercise. In the seated mode the user exercises the abdominal muscles by rocking the body first backward and then forward while seated in the articulated, adjustable-resistance, back-supported seating mechanism. The back support element of the seating mechanism is adjustable such that it may be lowered into a flat position, effectively converting the seat into a bench. In bench mode, the user, laying face up on the bench and holding onto the handlebar for stability, exercises the lower abs by performing leg-raising crunches. The machine is designed to be uniquely stimulating and fun to use.

In a first exemplary embodiment of the invention, the exercise machine has a pair of trampoline-like targets. The targets comprise a taught, springy surface against which a medicine ball thrown by a user will rebound back to the user. Their positions are adjustable such that they may be spread or narrowed to the desired horizontal placement, tipped to the proper vertical alignment and rotated to face the user. A user seated on the machine throws a weighted ball toward one of the targets. The medicine ball strikes the target and rebounds back toward the user. The user catches the ball and throws it again, either toward the same target or alternating between the two targets.

The seat of the exercise machine has an adjustable angle of inclination and utilizes a resistance-adjustable, articulated joint to provide the user some lower back support during exercise. It is configured so that as the user leans backward, the weight of the body pressing against the back of the seat forces it to recline. The mechanical action of the articulated joint lifts the seat bottom and the user's buttocks upward. When the user stops his rearward lean and begins to pull himself forward in the seat, the shift in the user's weight pressing down on the seat bottom tends to leverage the seat back forward, supporting the user's lower back as he returns himself to the upright position. The user rocks backward and forward while seated in the seat. He exercises the abdominals as he breaks his rearward fall and then again as he pulls himself back to his starting position. The seat back is not designed to assist the user in stopping or returning from a backward thrust, it simply supports the back during these motions, helping to prevent injury.

The angle of inclination of the seat is adjustable. This adjustability permits the user to increase or decrease the difficulty of the abdominal workout according to the user's particular strength level. A angled bench, in effect, applises resistance to the user's abdomen. A lower angle of inclination generates a more strenuous workout of the abominals during the rocking motion. The weight of the medicine ball as it is received during the user's backward motion, held and then thrown toward a target during the forward motion adds resistance to the user's abdominal muscles and also benefits the upper body muscles in the chest, back, shoulders and arms. The seat back support action is also adjustable so that users with weaker abdominal muscles may receive increased back support during the exercise, and vice versa for users with stronger abdominal muscles.

The seat also converts to an adjustable inclined bench by adjusting the seat back support mechanism so that the seat back lies flat and in line with the seat bottom. With the seat converted to the flat configuration, the user may lay face-up on the bench while performing a leg-lifting, knee-to-chest, crunch exercise. The adjustability of the angle of inclination of the bench permits varying degrees of intensity for the crunch exercise and also allows the user to focus attention on different areas within the abs.

The handlebar is a dual purpose attachment, consisting of a padded middle section and hand grips at both ends. The padded middle section is designed as a knee bolster. In the seated position, the user places the legs over the handlebars locking the back of the knees over the knee bolster. This helps keep the legs stationary during exercise.

In the bench mode, the handlebar also provides stability to the user. Laying face-up on the bench, the user positions himself with his head toward the front of the machine. To exercise, the user grasps the hand grips while lifting the legs and pulling the knees back toward the chest in a crunch exercise.

To use the machine in the seated mode, the user adjusts the targets as desired. Then he adjusts the angle of inclination and back support of the seat. Sitting with his legs over the handlebars, the user pulls his upper body forward, engaging the abdominal muscles, while extending the arms and throwing the ball at one of the targets. The ball rebounds from the springy target and the user catches it, retracting his arms and leaning backward as he absorbs the energy of the returning ball. As he leans backward, the seat back reclines. Then engaging the abdominal muscles again, the user breaks and stops his rearward motion and shifts his weight to pull himself forward. The weight-leveraged articulating action of the seat back partially supports the user's back during this breaking, stopping and forward motion. As he reaches an upright position, the user extends his arms, throwing the ball toward one of the targets and the cycle repeats itself. This repetitive action, while exercising the abdominal muscles also exercises the arms, shoulders and chest, provides a cardiovascular workout and is a lively and enjoyable activity. Because the activity is engaging and enjoyable, a user of the machine will tend to use it more frequently and for longer periods of time, thus benefitting himself in terms of his overall fitness.

The user may vary the workout, adjusting the machine or routine to target specific body areas. For example, if the targets are widely spread, the ball tossing action will tend to target the left and right obliques. Alternatively, the user may simply sit in the seat, rocking with or without the ball in hand, working only the main, frontal abs.

To use the machine in the bench mode, the user lowers the seat back into the bench position. Adjusting the angle of inclination, the user lays face up on the bench with his head or neck positioned in the vicinity of the handlebar. Grasping the hand grips, the user lifts his legs and pulls his knees in toward his chest, tightening the lower abdominals. Releasing the knees and returning the legs slowly to the floor completes the crunch exercise cycle.

The machine may be folded compactly for storage by raising the support legs, folding the seat flat and down against the frame and by folding the targets down against their support arms and rotating the support arms around under or near the main frame.

In a second embodiment of the invention, the machine may have only a single target. The position of this target is adjustable in a manner similar to either of the targets in the previous embodiment. In this embodiment, the user would need to adjust the position of the lone target to the left, right and center to exercise the same muscle groups as the two-target embodiment.

The gender of the "user" has been depicted as male throughout this discussion. This is only to simplify the writeup and is not meant to exclude use of the exercise machine by a person of the female gender.

In the exemplary embodiments described above, three or four supports are utilized to interconnect the upper ring and the lower ring; however a lesser or a greater number can be used without departing from the teachings of the present invention.

BRIEF DESCRIPTION OF THE DRAWINGS

Exemplary embodiments of the invention are discussed hereinafter in reference to the following drawings, in which.

DETAILED DESCRIPTION OF PREFERRED EXEMPLARY EMBODIMENTS

Figure 1:
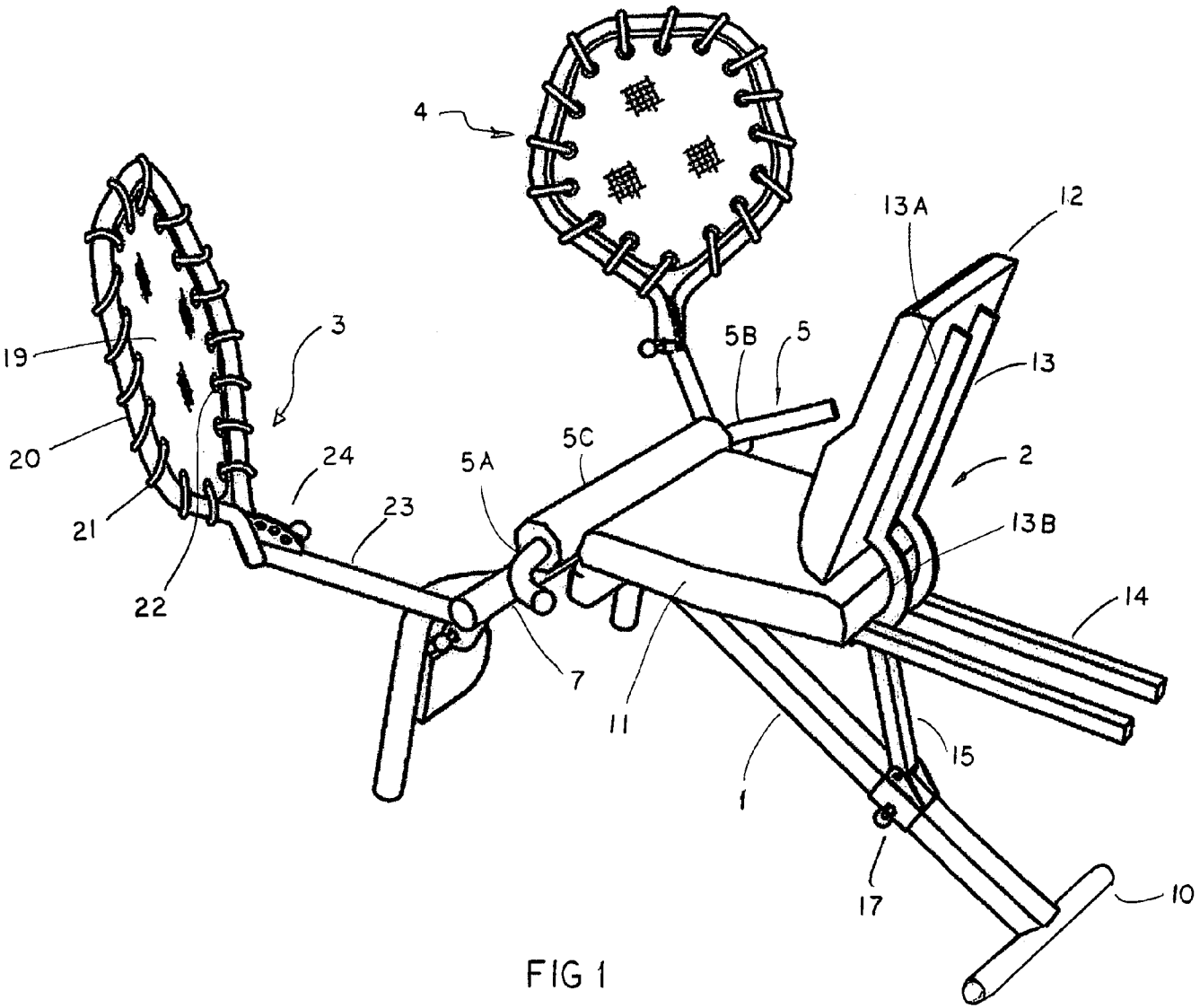
FIG. 1 is a perspective view of the exercise machine as shown from the rear of the left side.

As is illustrated in FIG. 1, a first embodiment of the present invention comprises an exercise machine having the primary components of a main frame 1, an adjustable seating mechanism (or seat) 2, a set of left and right targets 3 and 4, and a handlebar 5. Said primary components are interconnected and suitably adorned with minor components, some of which are herein described, but all of which are of a type and nature common to those skilled in the art of mechanical construction with the intent to safely market to the general public.

Figure 2:
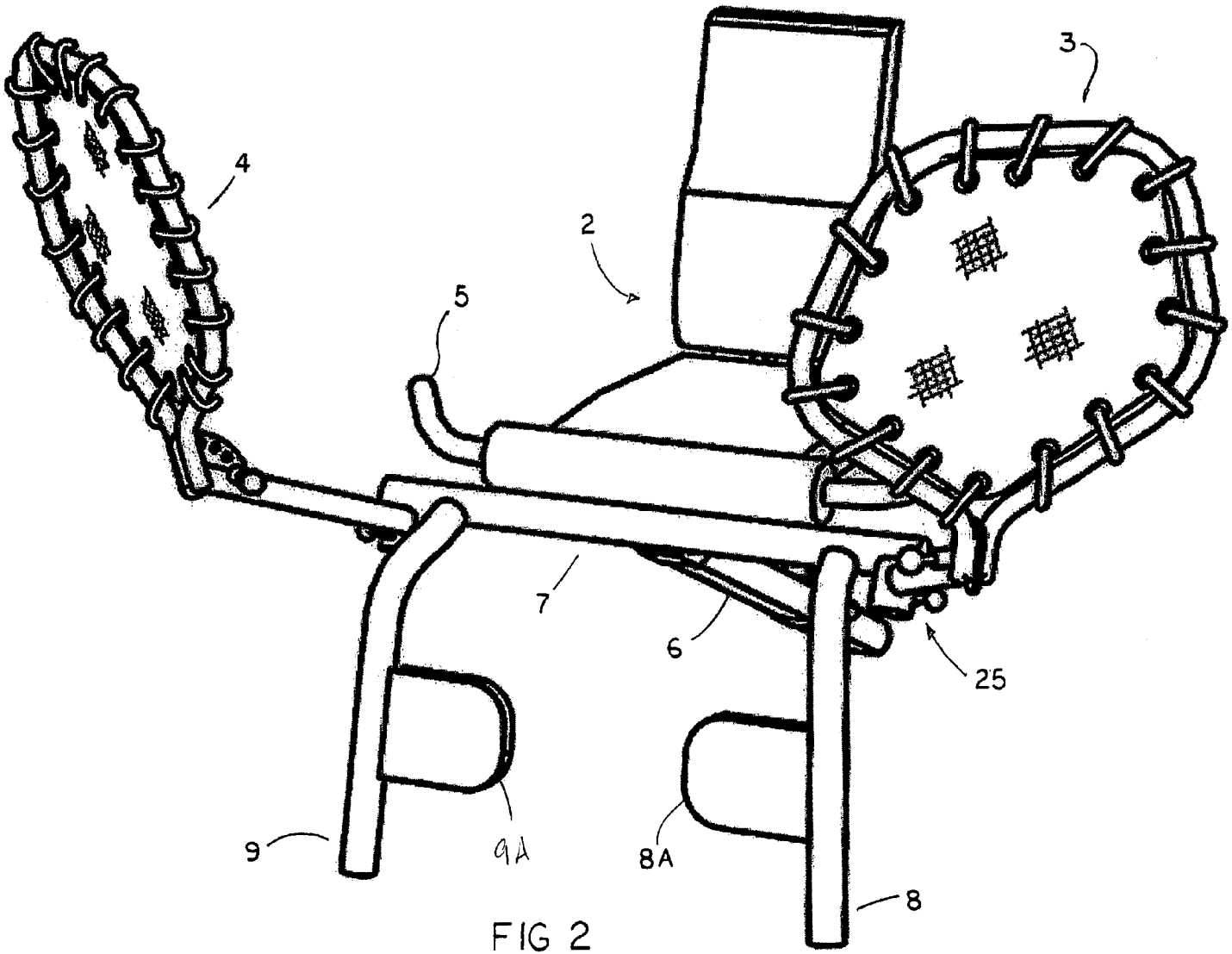
FIG. 2 is a view of the machine from the left front side.

The main frame 1 comprises a T-shaped structural element having a main bar 6 and a cross bar 7. The structure is supported in the front by a pair of left and right support legs 8 and 9 and stabilized in the back by a bottom stabilizer bar 10 as shown in FIG. 2. The components of the main frame may be manufactured from any suitable materials suitable for repeated use as will be seen from an exercise machine of this type.

Seat 2 is comprised of the primary components of a padded seat bottom 11 and a padded seat back 12. The seats components and their padding may be comprised of any materials commonly used for such purposes.

Seat back 12 is connected to a pair of seat back support arms 13. The support arms 13 are generally straight along the area (13A) connected to the rear of seat back 12 and are curved in the area (13B) below the seat back as shown in FIG. 1. This arrangement is also shown in FIG. 3A.

Figure 3:
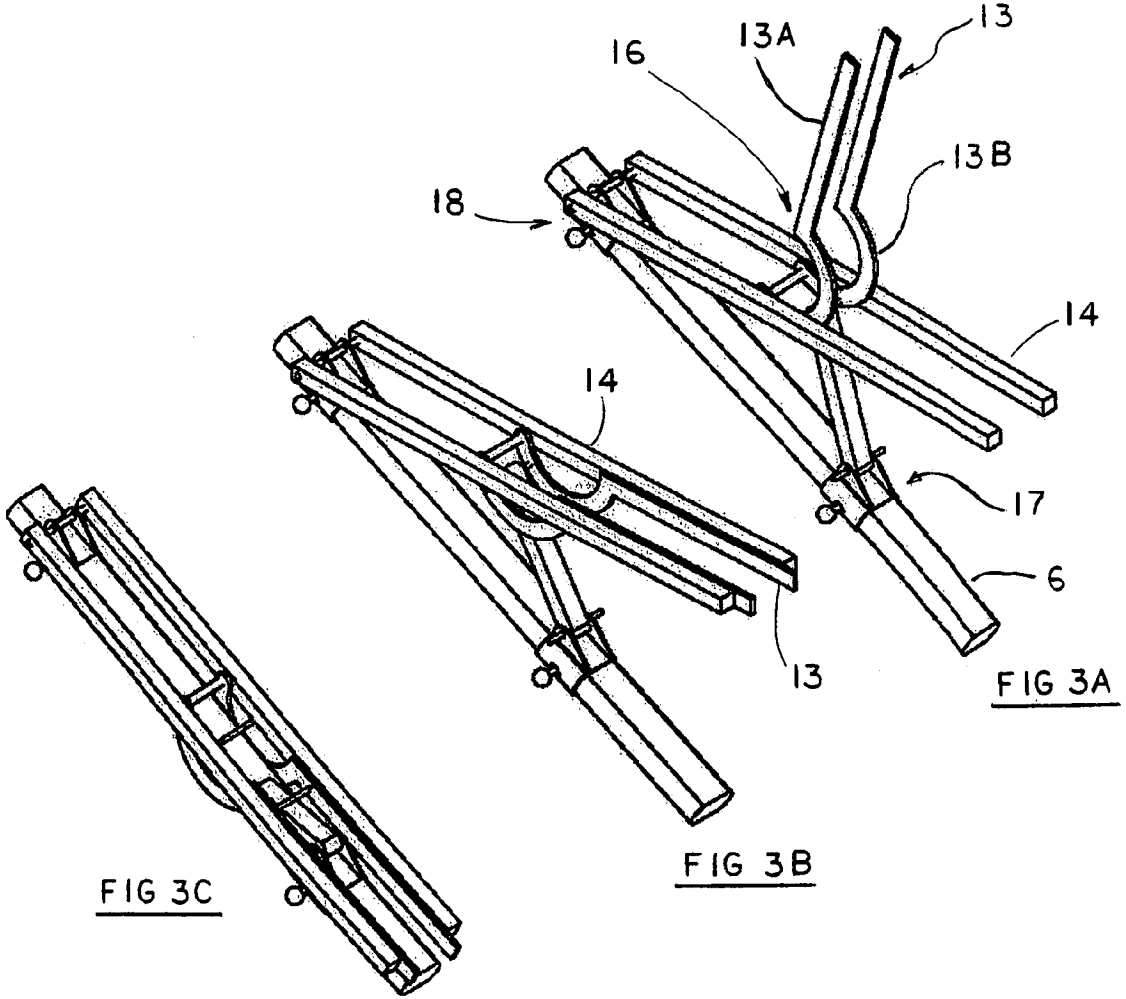
FIG. 3 is a three part drawing showing the mechanical operation of the articulated joint of the adjustable seating mechanism.

Seat bottom 11 is supported by a pair of seat bottom support bars 14 which are hingedly connected by an upper sliding connector 18 at their front ends to the upper end of main bar 6 as shown in FIG. 3. The upper sliding connector 18 may be of any type which is able to be unlocked from a suitable initial position on main bar 6, slid in either direction along the length of the main bar and locked in place at a suitable alternate position by the user of the exercise machine.

The seat bottom support bars 14 are also supported by seat support arm 15 at a point on the support bars beneath the rear end of seat bottom 11. The connection of support arm 15 to support bar 14 is achieved through weight-based, adjustable-support, mechanically-leveraged, double-action hinge (or articulated) joints 16 which rotatably interconnect seat back support arms 13 and seat bottom support bars 14 with the curved portions 13B of seat back support arms 13 as shown in FIG. 3A. Articulated joints 16 permit the seat to flex about the joints in a manner that partially supports the user's lower back during exercise. With the user seated on seat 2, the weight of the user's body presses downward on the seat bottom 11. The mechanically leveraged hinge transfers part of the body weight to the seat back 12, directing the force forward, toward the front of the machine and into the user's lower back. Thus, the action of leaning backward in the seat during exercise is partially resisted by the weight of the user's body pressing downward on the seat bottom 11. This supports the lower back during exercise.

Figure 7:
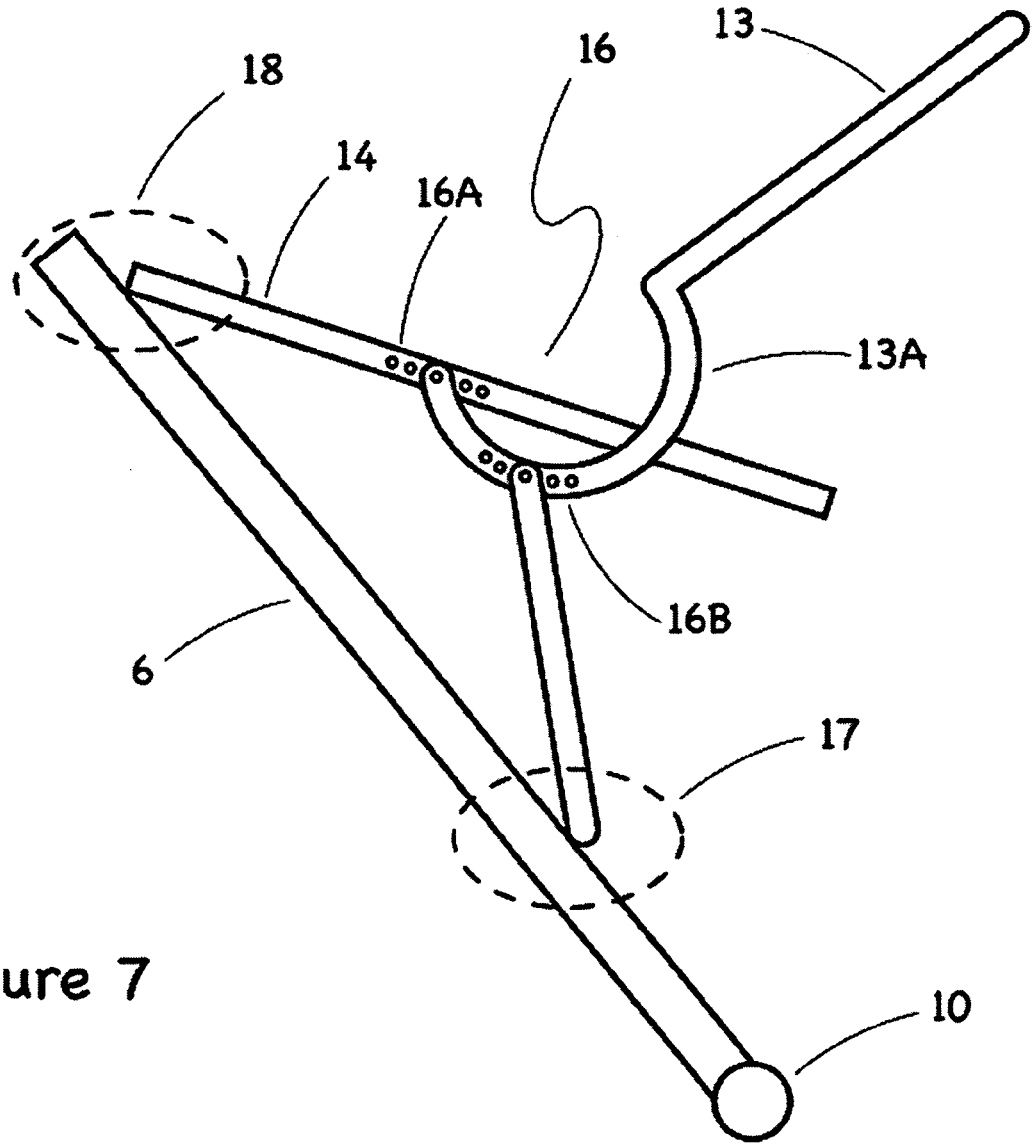
FIG. 7 is a detailed view of one embodiment of the articulated joint design of the adjustable seating mechanism.

The amount of back support provided by the seat back may be adjusted by varying the points of interconnection of the seat support arm, seat bottom support bars and seat back support arms within the articulated joint. This variable interconnection may be achieved as shown in FIG. 7 by providing series of seat bottom bar holes 16A along the length of the seat bottom support bars 14 and seat back curve holes 16B along the curved portion 13A of the seat back support arms 13. Hinge pins (not shown) adjusted among the holes will provide greater or lessor degrees of leverage and back support to the user.

FIG. 7 indicates a curved bar with pin and hole arrangement for the articulated joint 16 of seat 2. However, any other suitable arrangement providing a weight-based, adjustable-support, mechanically-leveraged, double-action hinged joint facilitating the back support function of joint 16 as described for seat 2 may be employed in the exercise machine without prejudice to the inventive concept herein disclosed.

Seat support arm 15 is connected at its lower end to main bar 6 via a lower sliding connector 17. The lower sliding connector 17 may be of any type which is able to be unlocked from a suitable initial position on main bar 6, slid in either direction along the length of the main bar and locked in place at a suitable alternate position by the user of the exercise machine.

Figure 5:
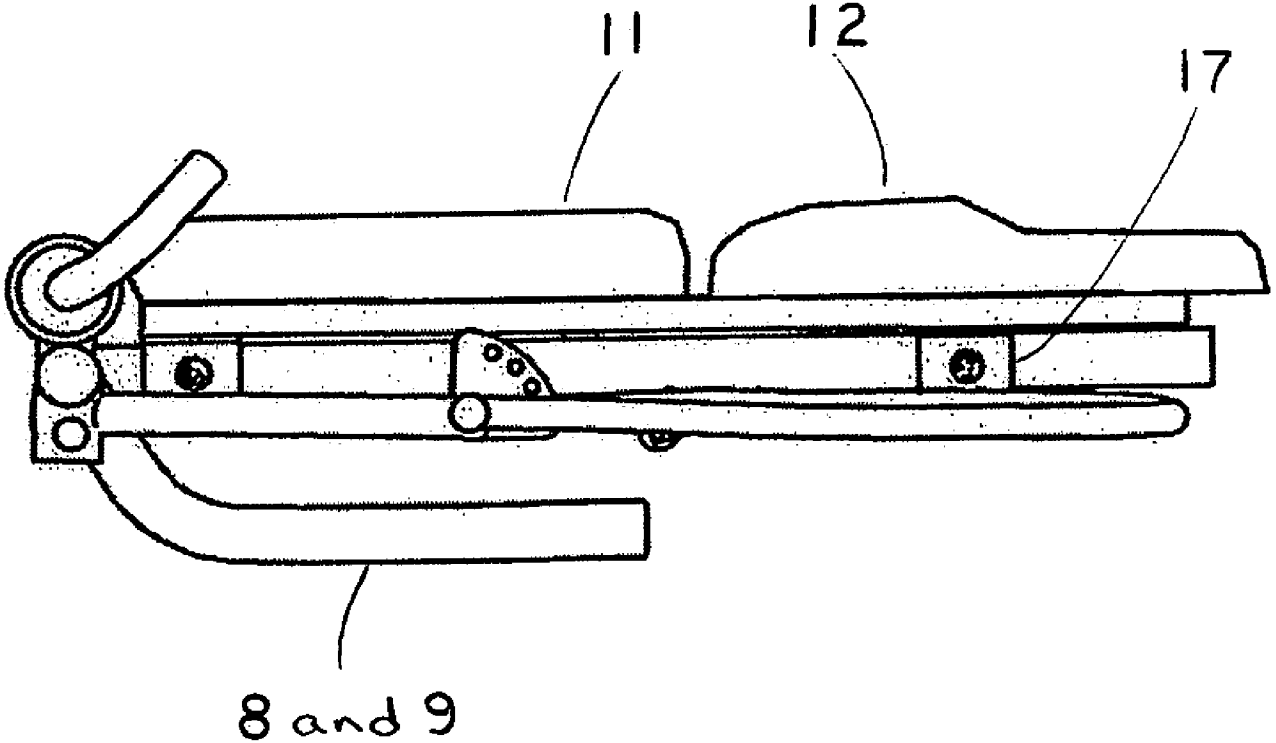
FIG. 5 is view of the first embodiment folded for storage.

The upper and lower sliding connectors (18 and 17) working in conjunction with articulated joint 16 permit the height and inclination of seat 2 to be adjusted as desired by the user. Their operation also enables seat back 12 to be folded completely backwards such that it rests against seat bottom support bars 14. In this position, the seat back support arms 13 come to rest in line with the seat bottom bars. This situation is shown in FIG. 3B. In this configuration the L-shaped seat 2 becomes a flat "bench" (11 and 12 together) as can be seen in FIG. 5. Further adjustment of the above three joints enables the support arms 13 and support bars 14 to nest with main bar 6 as shown in FIG. 3C enabling the machine to be folded flat for storage as shown in FIG. 5.

Left and right targets 3 and 4 are each comprised of a resilient surface 19 bound to an outer ring 20 and a target arm 23 as shown in FIG. 1. Surface 19 may be comprised of any suitable material such that when it is attached to ring 20 the surface becomes springy. That is, when an object is thrown against the resilient surface it will tend to rebound off the surface. The method of attachment of the surface 19 to the ring 20 may comprise an elastic band 21 wound around the ring and passed through a grommet 22 in the surface as shown in FIG. 1. While the above method of attachment is suitable it is not the only method available and any suitable method may be employed without departing from the teachings of the invention.

Figures 4, 4A, 4B, 4C, 4D:
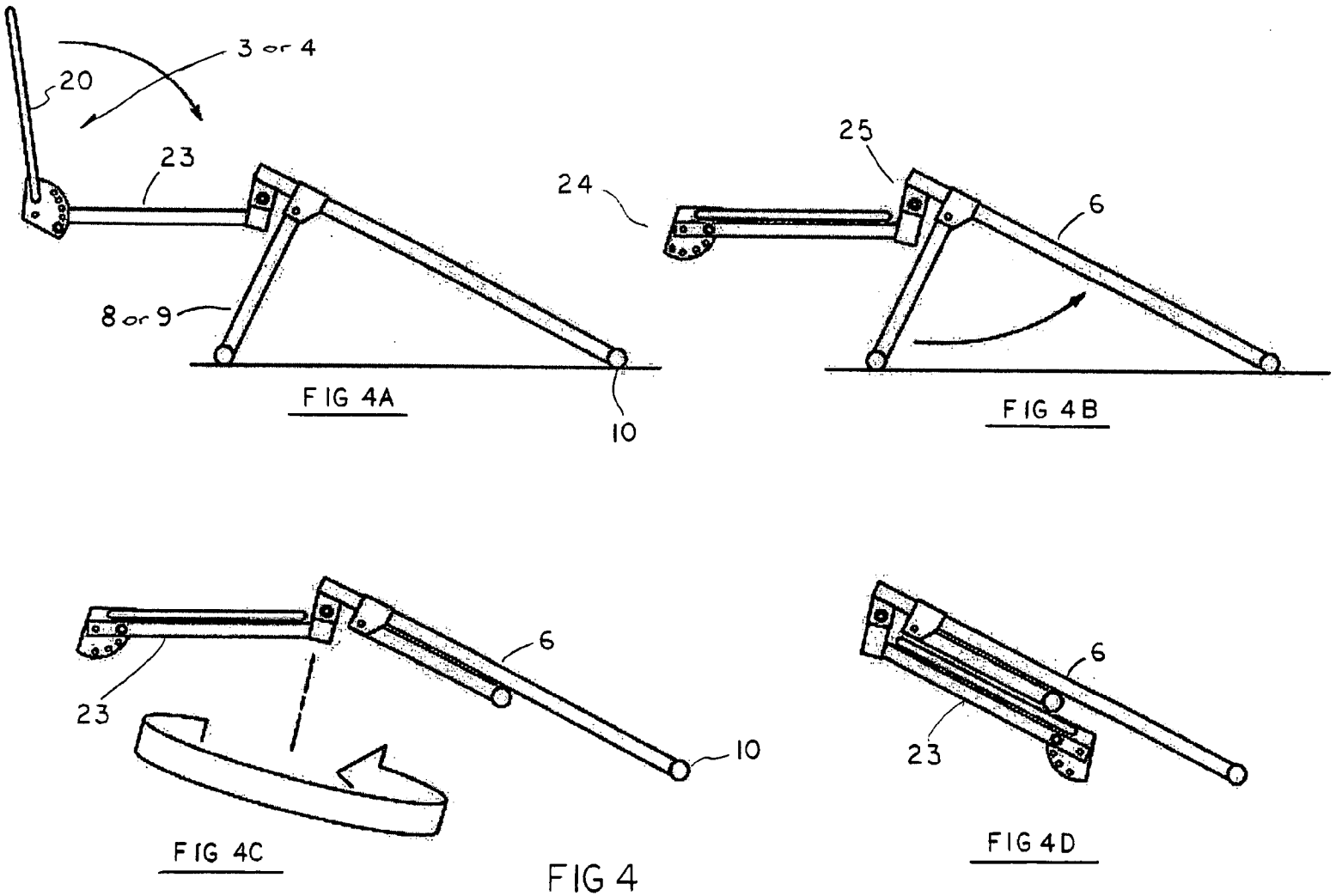
FIG. 4 is a is a four part drawing indicating conceptually how the targets fold for storage.

Targets rings 20 are mounted on target arms 23. The rings are connected to the outer ends of the target arms via a vertical adjustment connection 24 as shown in FIGS. 1 and 4. The vertical adjustment connection may be as shown in FIGS. 1 and 4 or it may be of any other type which allows adjustment of the position of targets 3 and 4 vertically into or away from to the user of the exercise machine and rotationally about the vertical axis of the target without departing from the scope of the invention. At the extremes, the connection permits the targets to be folded down flat against the target arms for storage as shown in FIG. 4.

The inner ends of target arms 23 are connected to the exercise machine at either end of cross bar 7. This attachment is made via a horizontally rotatable connection 25 which permits movement of the two arms toward or away from each other as well as the temporary fixing of the arms into position after such movement by the user. At the extreme, the arms may be rotated beneath the main bar 6 for storage of the exercise machine as shown in FIGS. 4C and 4D. This connection 25, which is indicated in FIGS. 2 and 4 may be of any suitable type common to those familiar with the design of such machines without departing from the teachings of the invention.

The handlebar 5 is a simple bar, comprised of any suitable material and shaped as a straight center section (not shown) with left and right angularly projected handgrips 5A and 5B at each end. The shape of the handgrip bends is designed to offer the user ergonomically comfortable body stabilization during exercise. Surrounding the center section of the handlebar is a padded knee bolster 5C. The knee bolster is comprised of any material suitable for use as a durable and comfortable pad over which to rest the inside of the user's knees during exercise.

Left and right legs 8 and 9 are structural tubular sections formed with suitable knee bends and fitted with shin bolsters 8A and 9A as shown in FIG. 2. The manufacture of the legs is such that a user seated on seat 2 may place his legs over cross bar 7 and his shins behind the shin bolsters to enable the user to sit securely on the machine.

Figure 6A:
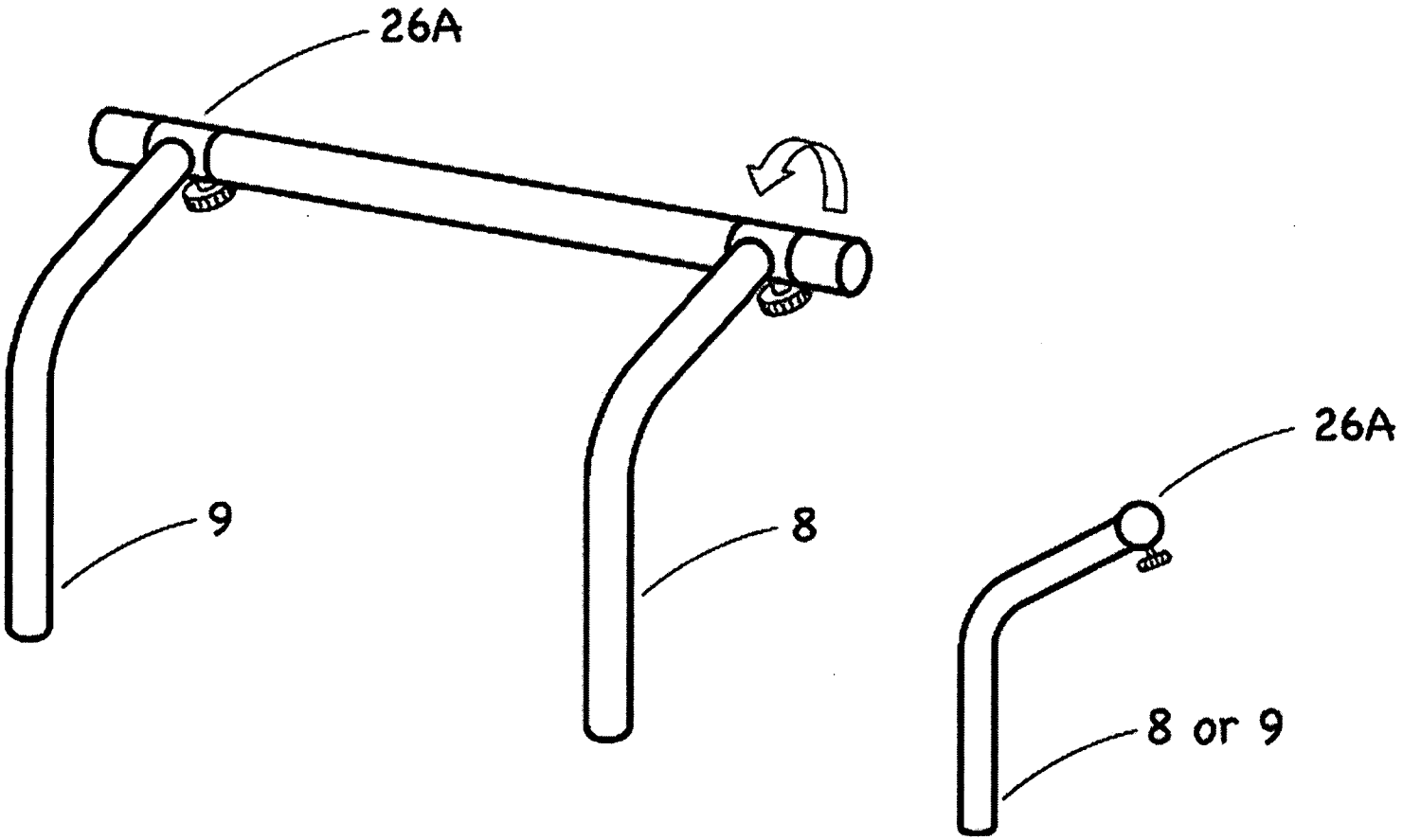
FIG. 6A is a detail of the rotatable joints of the support legs of the first embodiment of the invention.
Figure 6B:
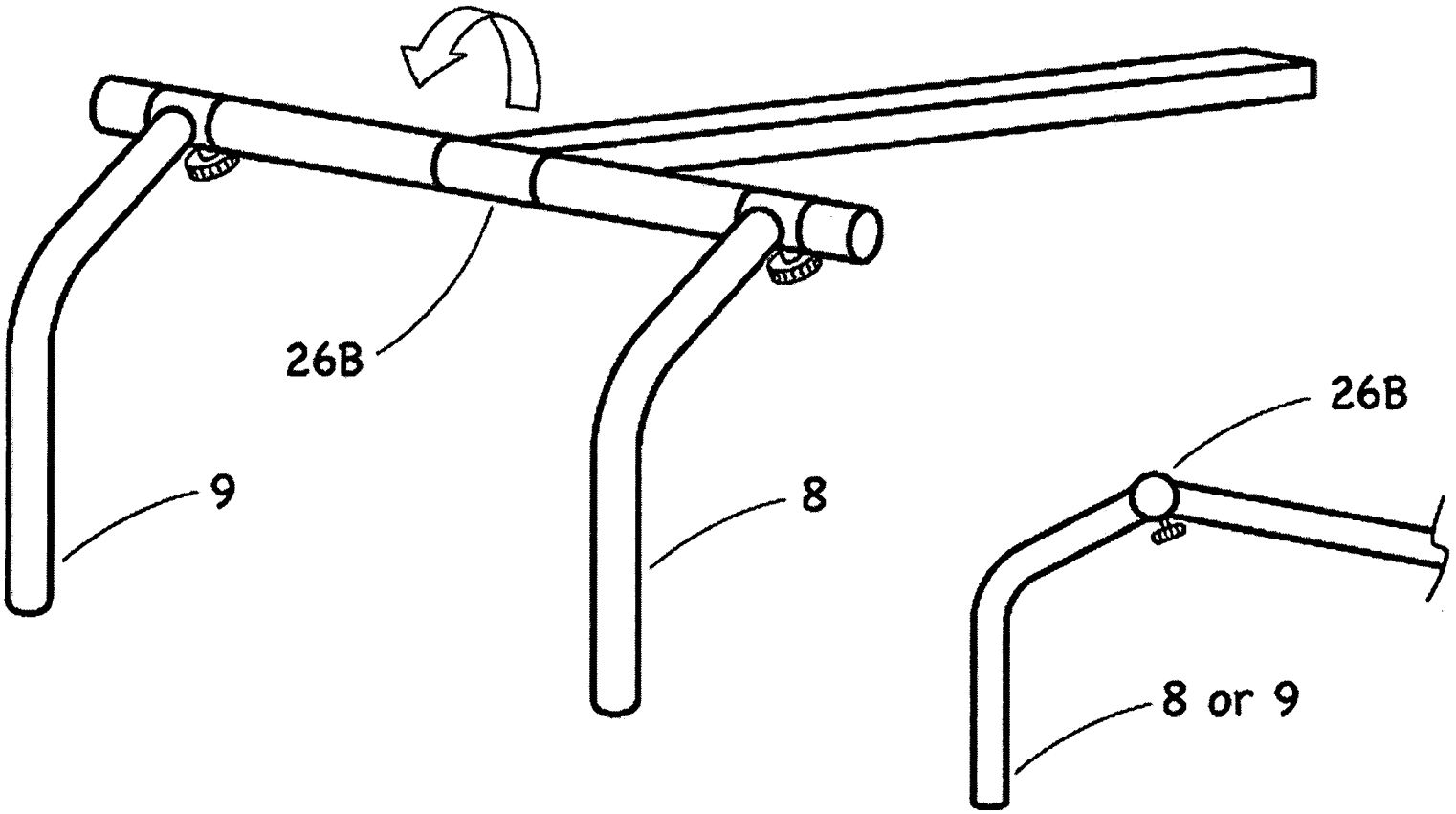
FIG. 6B is an alternate detail of the rotatable joints of the support legs of the first embodiment of the invention.

The connection of the main bar 6 to the stabilizer bar 10 is a rigid connection as required for the type of materials used. Left and right legs 8 and 9 may be attached to cross bar 7 in a vertically rotatable leg connection 26A as shown in FIG. 6A. Alternatively, the cross bar may be attached to main bar 6 in a vertically rotatable cross bar connection 26B as shown in FIG. 6B. The connections indicated in FIGS. 6A and 6B may be achieved by a rotating sleeve with threaded thumbscrew pin or by any other suitable means without departing from the teachings of the invention. The purpose of rotatable connections (26A or 26B) is to permit folding of the legs about cross bar 6 and under main bar 6 for storage as shown in FIG. 5.

The exercise machine of the present invention has two primary modes of exercise. These are the seat mode and the bench mode.

Figure 8:
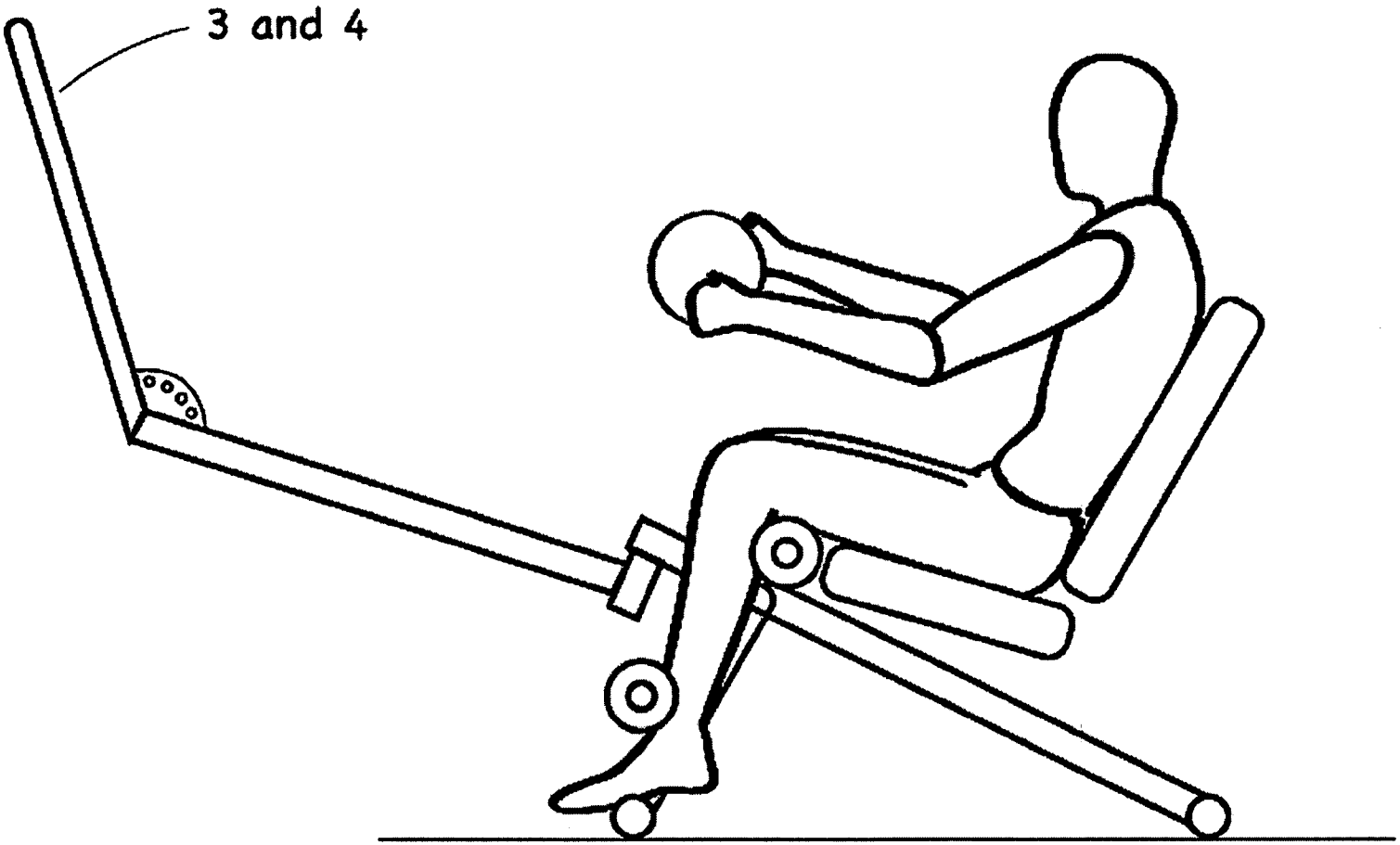
FIG. 8 indicates how the exercise machine is used in the seated mode.

In the seat mode, seat back 12 is in the raised position as shown in FIG. 1. The upper and lower sliding connectors 18 and 17 and articulated joint 16 are adjusted to provide the desired amount of back support by the user. Target arms 23 are adjusted horizontally (wider apart or closer together) and left and right targets 3 and 4 are adjusted vertically to desired positions. The user sits on seat bottom 11 with the legs bent over knee bolster 5C and the shins behind shin bolsters 8A and 9A as shown in FIG. 8. Holding a weighted ball, the user tosses the ball at targets 3 and 4, rotating his body toward each target as he alternates between the two surfaces and gently rocks backward and forward against seat back 12. This engages the main abdominal muscles and to the extent that the target arms 23 are separated, it also engages the oblique abdominal muscles.

In another application of the seat mode of the invention, the user simply rocks back and forth in seat 2 with our without holding on to the weighted ball or any other weighted object. This action primarily engages the main abdominals.

Figure 9:
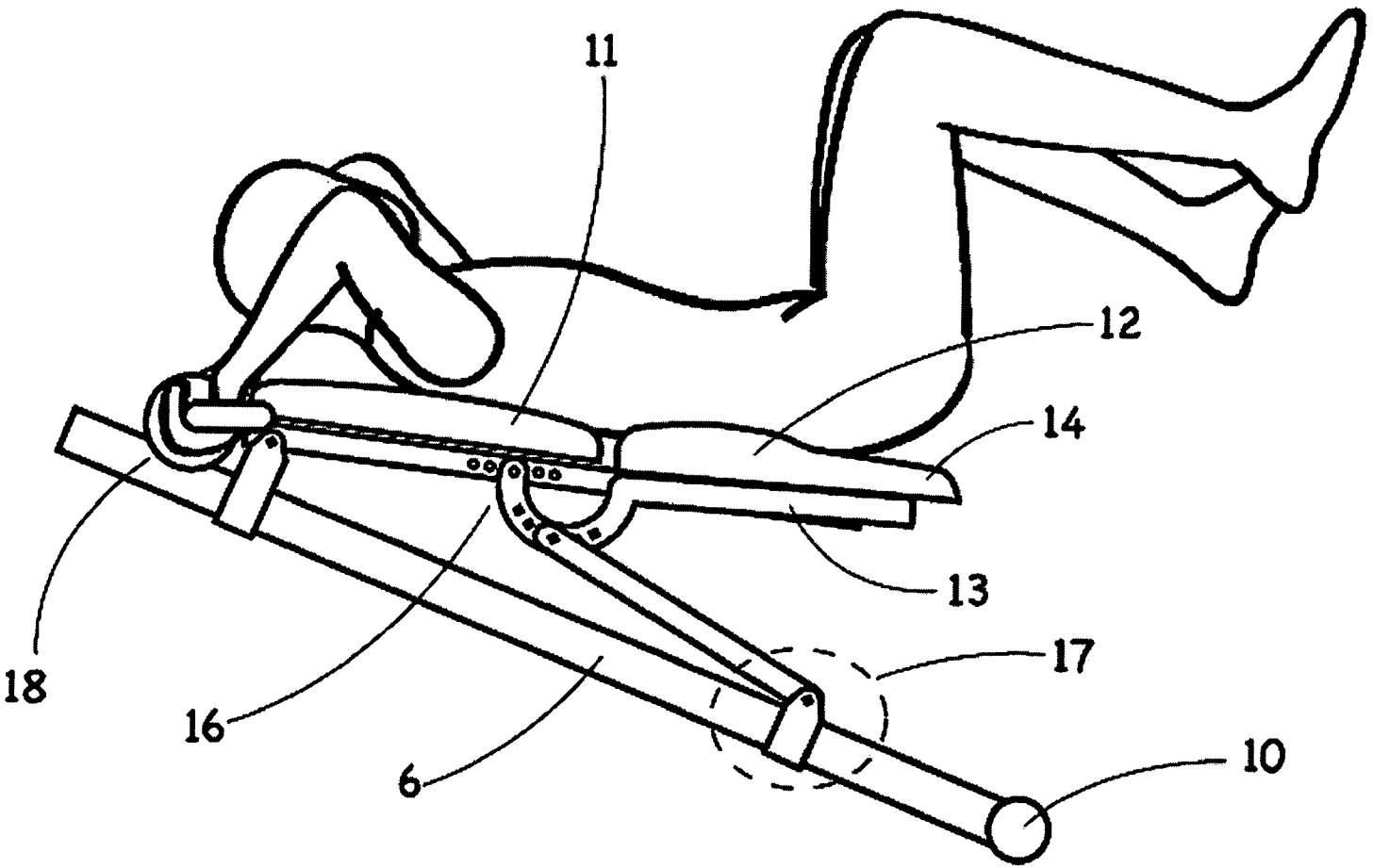
FIG. 9 indicates how the exercise machine is used in the bench mode.

In the bench mode, seat back 12 is reclined to touch the seat bottom support bars 14 transforming the seat 2 into a bench (11 and 12 together) as shown in FIG. 5. The upper and lower sliding connectors 18 and 17 and articulated joint 16 are adjusted to provide the desired amount of pitch to the bench. The positions of the target arms and targets are not important since they are not involved in the bench mode. The user lays on his back with his head toward the handlebar 5 and grasps left and right handgrips 5A and 5C as shown in FIG. 9. The user raises the legs, pulling the knees toward the chest. This engages the main, principally lower abdominal muscles.

To fold the machine for storage, first seat back 12 is folded down until it comes to rest against seat bottom support bars 14 as in the bench exercise mode. Second, targets 3 and 4 are folded down against target arms 23 as shown in FIG. 4A. Third, arms 23 are rotated underneath main bar 6 as shown in FIGS. 4C and 4D. Finally, legs 8 and 9 are rotated about the axis of cross bar 7 until they reach the storage position as shown in FIG. 5. The machine is now ready for storage. To use the exercise machine, it is un-folded in the reverse order described above.

Figure 10:
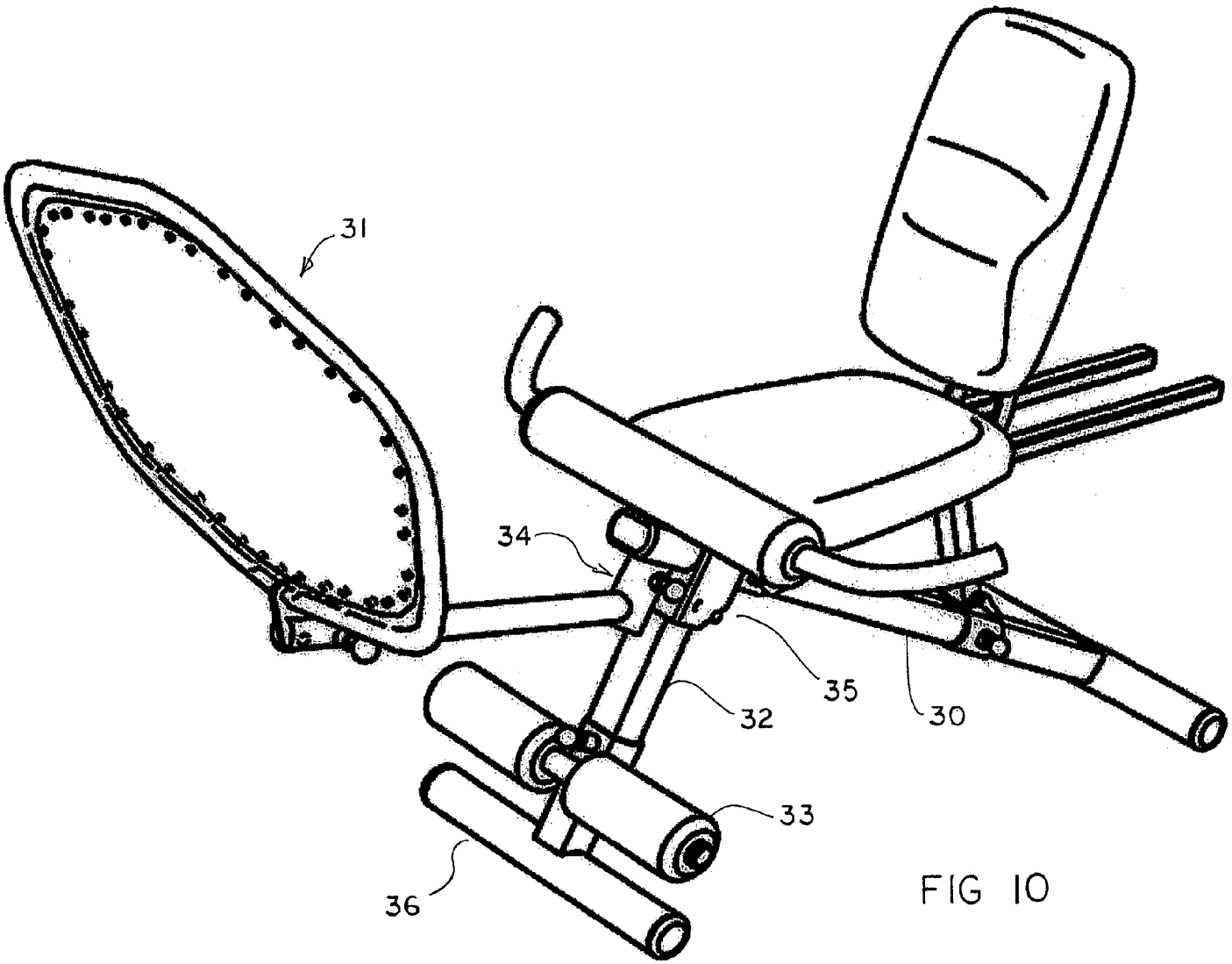
FIG. 10 is a perspective view of the second embodiment of the exercise machine. This embodiment has only a single target and single support leg.

In a second embodiment of the present invention the exercise machine may be manufactured with only a single target. In this embodiment, the configuration may be adjusted as shown in FIG. 10. Principal changes to the design of the machine comprise no cross bar on the main frame 30, a single target 31, a single front support leg 32 with ankle bolsters 33, and alternative connections of the single target and support leg to the main frame to permit folding of the same for storage.

The single target 31, including the resilient surface, outer ring and target arm is of the same basic design as the target of the prior embodiment. The difference to the target lies in its method of connection to the main frame. Target attachment to the main frame is accomplished via an extended horizontally rotational connection 34 as shown in FIG. 10.

Figure 11:
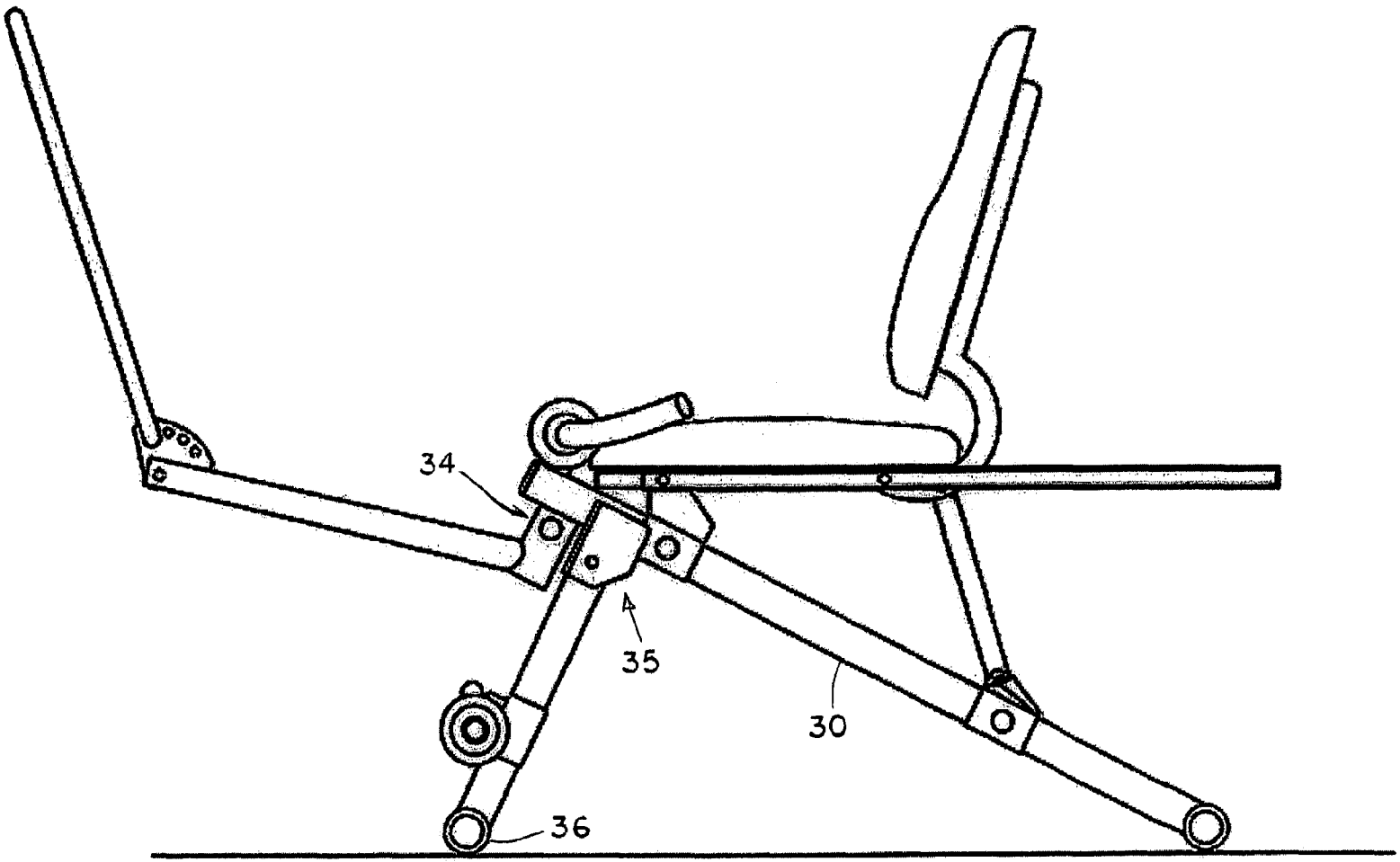
FIG. 11 is a side view of the second embodiment of the invention.
Figure 12:
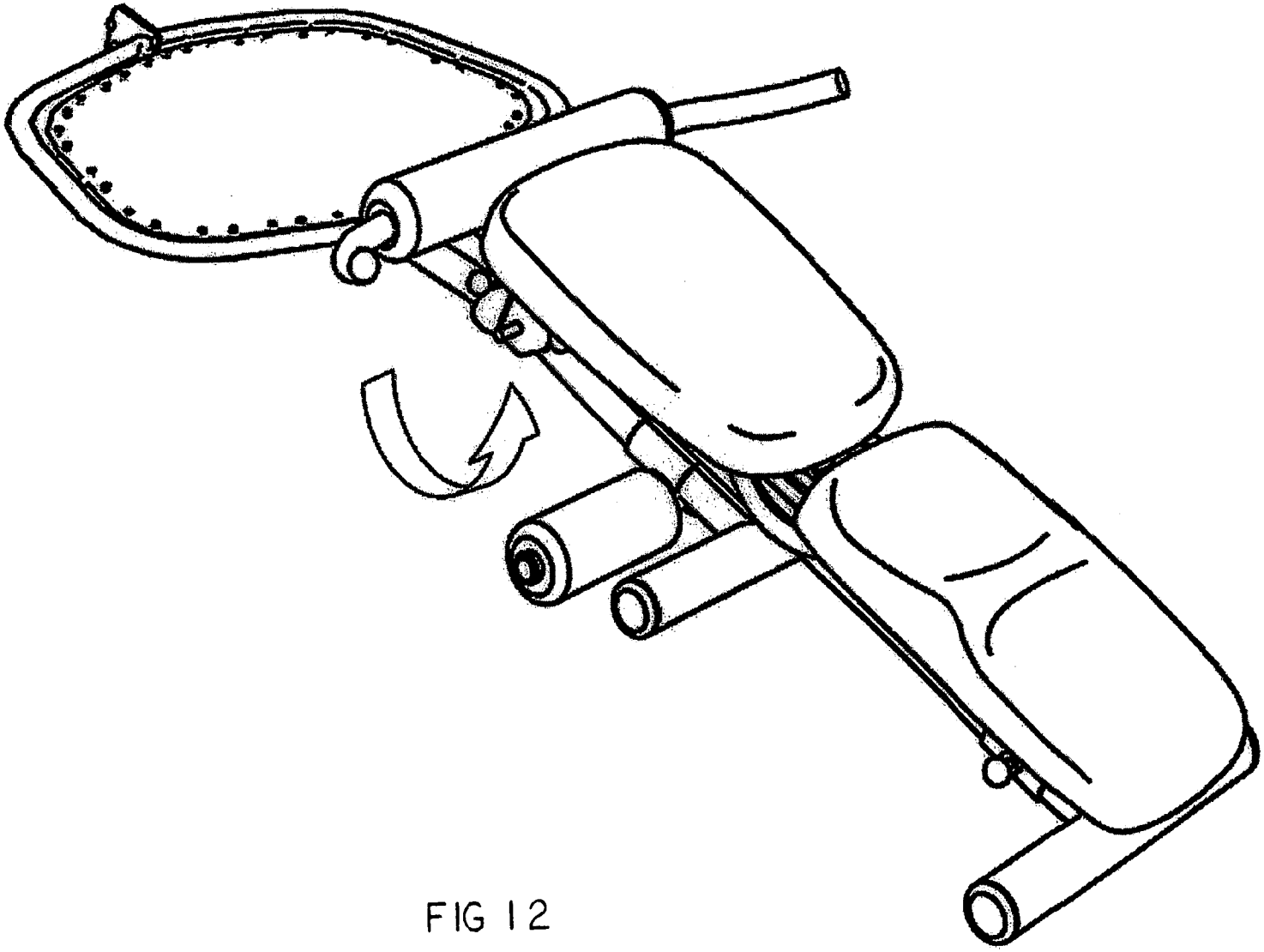
FIG. 12 is a view of how the leg of the second embodiment folds for storage.

Front support leg 32 comprises a bar connected at its upper point to the main frame 30 by a support bar hinge connection 35 as shown in FIG. 11. A front leg stabilizer bar 36 is connected to the bottom of the front support leg. Hinge connection 35 permits folding of the front leg prior to storage of the machine as shown in FIG. 12.

Ankle bolsters 33 comprise a single bar, connected to front leg 32 as shown in FIG. 10. The padding of the bolsters is similar in nature to the padding of the knee bolster 5C described above. The ankle bolsters may alternatively be manufactured from a pair of bars connected to the sides of front leg 32 without departing from the scope of the present invention.

The second embodiment again has two modes of exercise: the seat mode and the bench mode.

In seat mode, the user adjusts target 31 to the to the center, left or right and vertically as desired and sits upon the seat with legs over the knee bolster and behind the ankle bolster 33. As in the prior embodiment, the user tosses a weighted ball at the target while rocking back and forth in the seat. With the target in a left or right position, the user exercises the oblique abdominals in addition to the main abdominals. With the target adjusted to a central position, the user exercises primarily the main abdominals. Alternatively as before, the user may simply rock in the seat with or without a weighted object.

Figure 13:
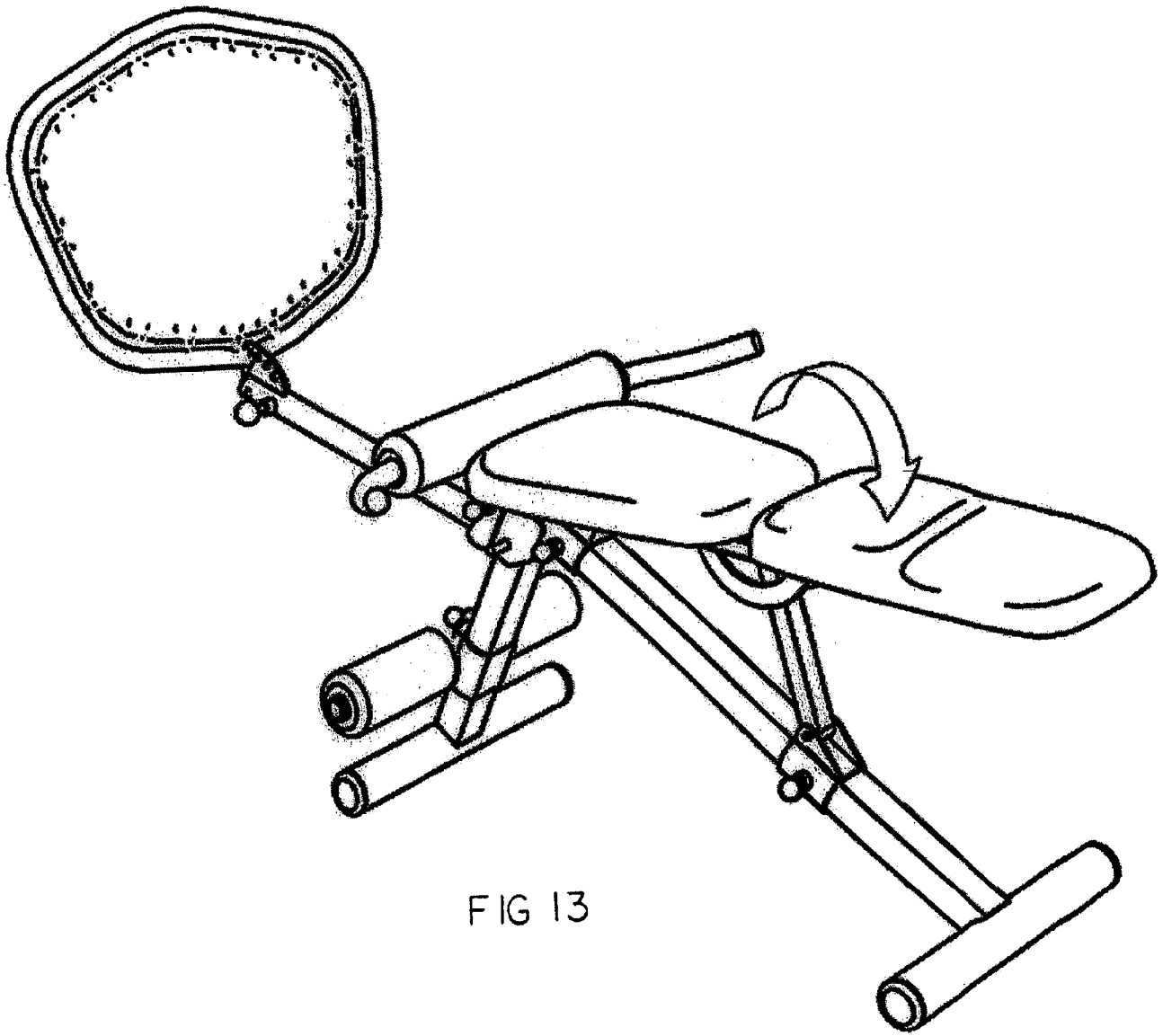
FIG. 13 shows how the seat converts to a bench for exercise.

Use of the second embodiment in the bench mode is the same as in the first embodiment. A view of the machine configured for the bench mode is shown in FIG. 13.

Figure 14:
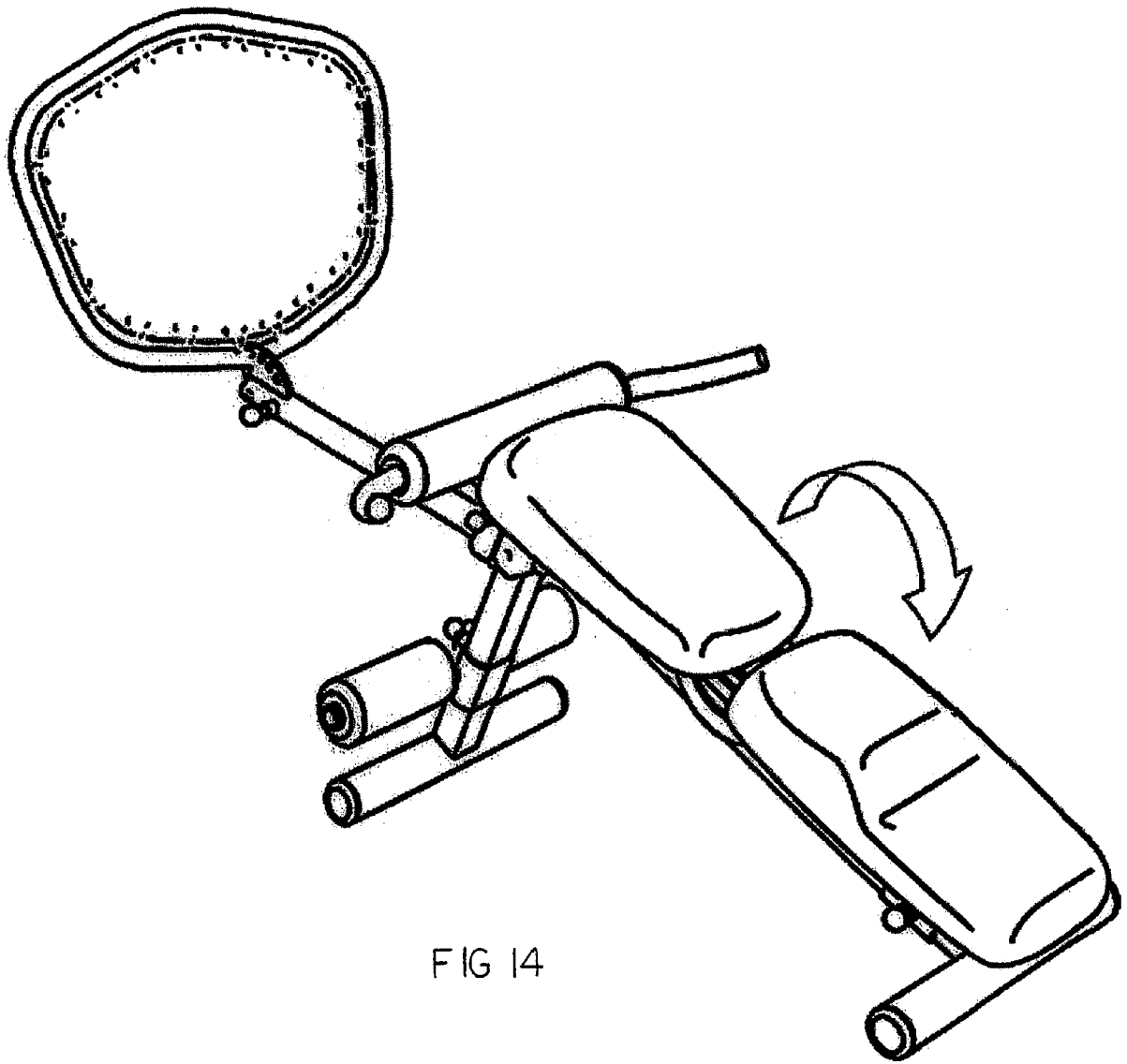
FIG. 14 shows how the bench lowers for storage.
Figure 15:
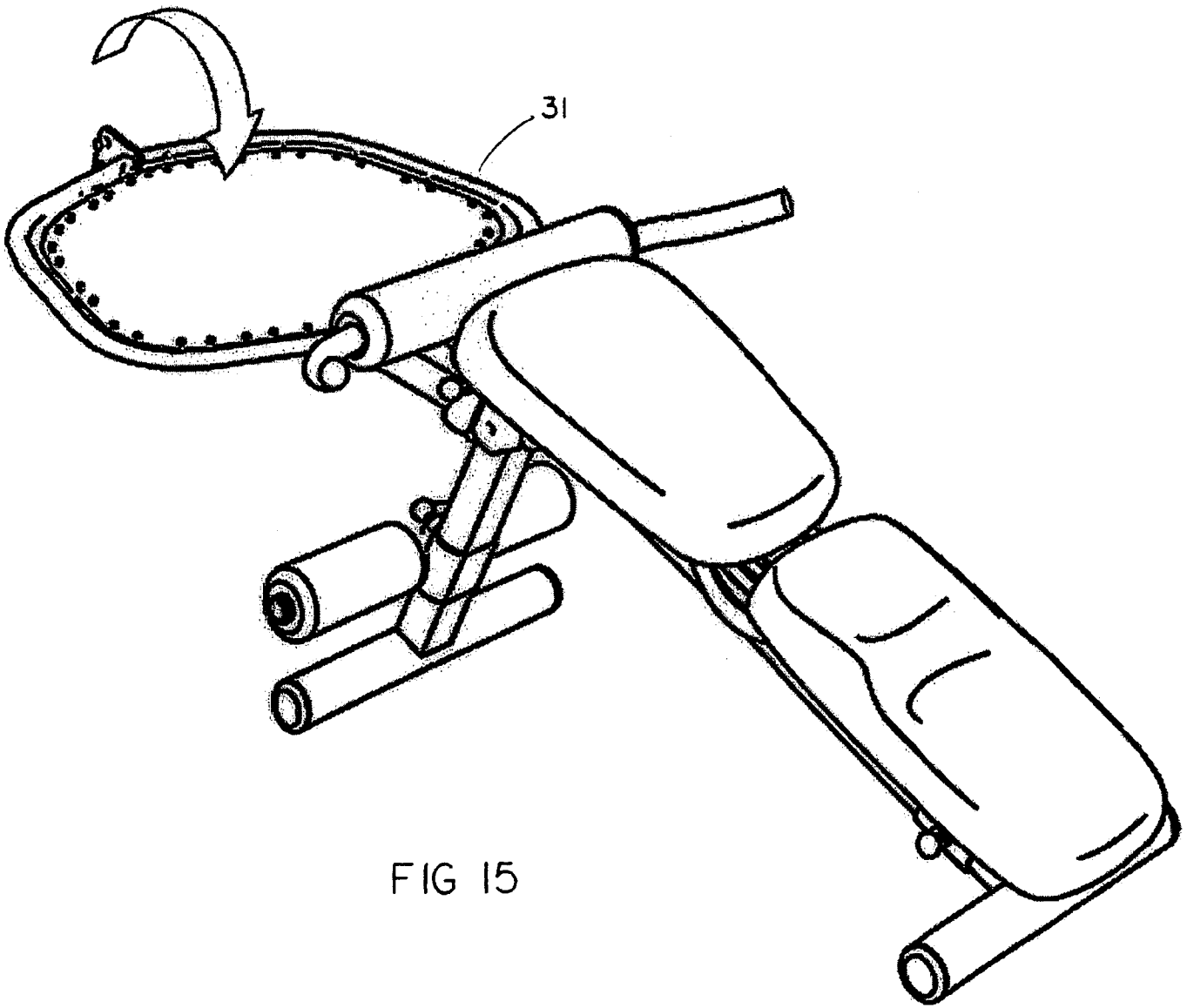
FIG. 15 indicates how the target folds down for storage.
Figure 16:
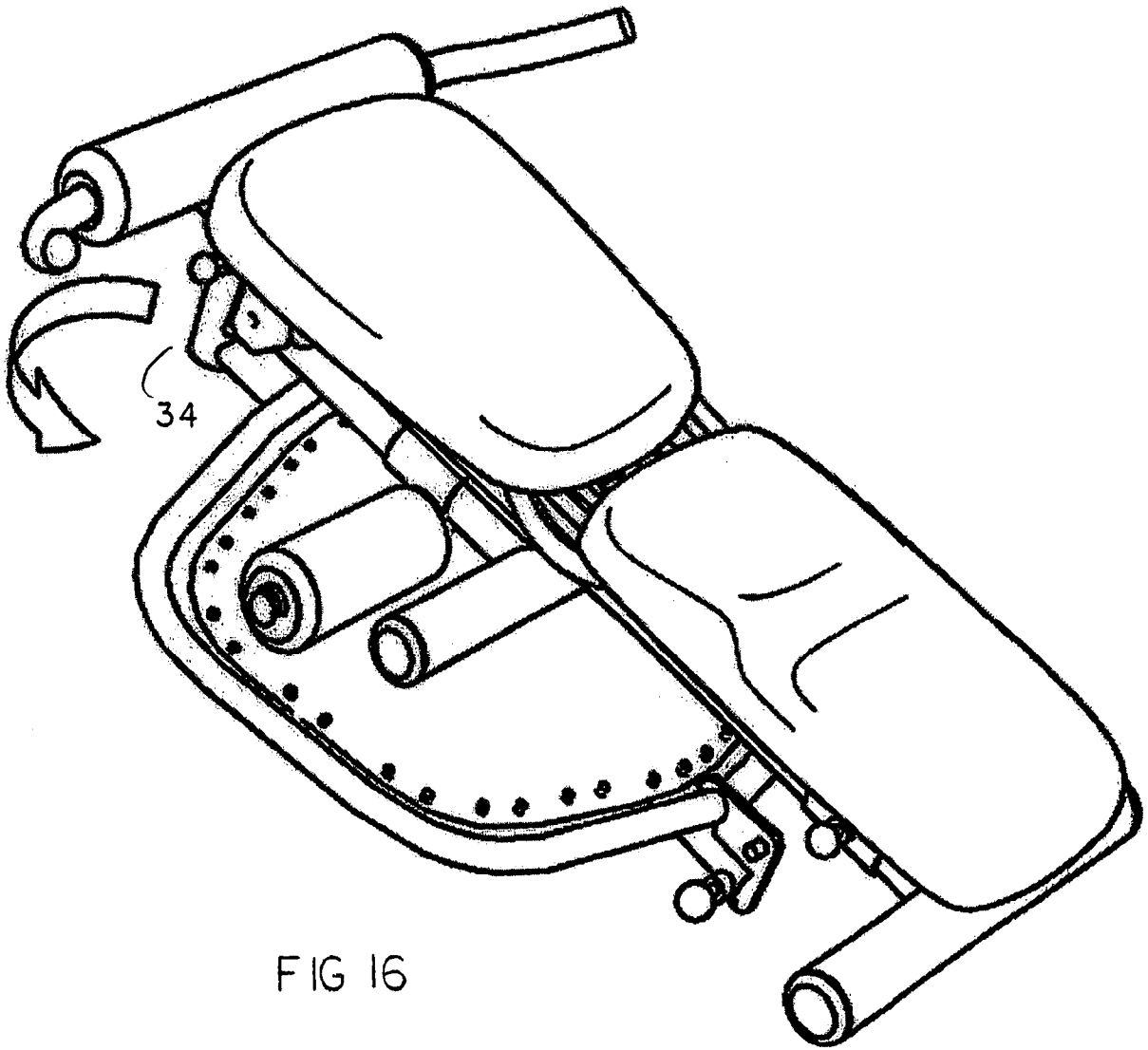
FIG. 16 indicates how the target arm with the target ring folded down pivots for storage.

To fold the machine for storage, the seat is folded into the bench configuration as in the prior embodiment. This is as shown in FIG. 14. The target 31 is then folded forward as shown in FIG. 15. Next, front leg 32 is folded up under the main frame as shown in FIG. 12. Then the target arm is rotated about the rotational connection 34 as shown in FIG. 16.

In any of the above embodiments, the act of tossing the weighted ball against one or more targets engages not only the abs but also the shoulders and arms. This strengthens these body areas and further provides a cardiovascular workout for the user.

Because many varying and different embodiments may be made within the scope of the inventive concept herein taught, and because many modifications may be made in the embodiments herein detailed in accordance with the descriptive requirements of the law, it is to be understood that the details herein are to be interpreted as illustrative and not in a limiting sense.

The invention claimed is:

1. An exercise machine, comprising:

a main frame;

an adjustable seating mechanism attached to said main frame to vary the degree of difficulty of the exercise motion; and one or more targets, each target comprising an arm that is attached to said main frame, wherein each target comprises a material surface such that when an object is thrown against each target the object can rebound off of the material surface.

2. The exercise machine of claim 1 wherein said main frame comprises:

a main bar; and a cross bar rigidly connected to the upper front end of said main bar;

left and right support legs rotatably connected to said cross bar; and a bottom stabilizer bar rigidly connected to the lower, back end of said main bar.

3. The exercise machine of claim 2 wherein said adjustable seating mechanism comprises:

a seat support arm which is connected at its lower end to said main bar via a lower sliding connector; and a padded seat bottom attached to a pair of seat bottom support bars which are connected at their upper ends to the main bar of claim 2 via a hinged upper sliding connector and are hinge supported beneath said padded seat bottom by said seat support arm;

a padded seat back attached to a pair of seat back support arms having a straight section at the attachment point to said padded seat back which also have a lower curved section extending beyond the padded seat back and attaching to said seat bottom support bar and said seat support arm; and an articulated joint interconnecting said seat support arm and seat bottom support bars with said seat back support arms through a mechanically-leveraged, double-action hinge connection in a manner that provides a user of said machine with user-weight generated, adjustable, lower back support during seated exercise.

4. The exercise machine of claim 1 wherein the material surface of each said target comprises a resilient surface, and wherein each target comprises an outer ring such that the object thrown against said resilient surface will tend to rebound elastically off said resilent surface.

5. The exercise machine of claim 4 wherein said target arm connects to the outer ring in such a manner that:

said outer ring may be adjusted vertically into or away from to the user of said exercise machine and lock into place where desired by said user; and said outer ring may be adjusted rotationally about the vertical axis of said outer ring and locked into place where desired by said user; and the connection permits said outer ring to be folded down flat against said target arm for storage.

6. The exercise machine of claim 4 wherein said target arm further connects to the cross bar in such a manner that:

said target arm may rotate horizontally about the vertical axis of said connection to said cross bar and lock into place where desired by a user of said machine; and said connection to said cross bar permits said target arm to be rotated alongside or underneath the main frame of claim 1 for storage.

7. The exercise machine of claim 3 wherein said adjustable seating mechanism further provides adjustability of said seat bottom support bar and seat support arm sliding connections in such a way that permits leveling or inclining said seating mechanism at a desire of a user of said exercise machine; and adjustability of said seat bottom support bars and seat support arm with said seat back support arms permitting said padded seat back to fold flat against said seat bottom support bars and transforming said adjustable seating mechanism into an inclinable bench for exercise or storage.

8. An exercise machine, comprising:

a main frame;

an adjustable seating mechanism attached to said main frame to vary the difficulty of the exercise motion; and one target with an arm that is attached to said main frame, wherein the target comprises a material surface such that when an object is thrown against the target the object can rebound off of the surface.

9. The exercise machine of claim 8 wherein said mainframe comprises:

a main bar;

a bottom stabilizer bar rigidly connected to the lower, back end of said main bar;

a front support leg; and a front leg stabilizer bar rigidly connected to the bottom of said front support leg.

10. The exercise machine of claim 8 wherein said adjustable seating mechanism comprises:

a seat support arm which is connected at its lower end to said main bar via a lower sliding connector;

a padded seat bottom attached to a pair of seat bottom support bars which are connected at their upper ends to said main bar via a hinged upper sliding connector and are hinge-supported beneath said padded seat bottom by said seat support arm;

a padded seat back attached to a pair of seat back support arms having a straight section at the attachment point to said padded seat back which also have a lower curved section extending beyond the padded seat back and attaching to said seat bottom support bar and said seat support arm; and an articulated joint interconnecting said seat support arm and seat bottom support bars with said seat back support arms through a mechanically-leveraged, double-action hinge connection in a manner that provides a user of said machine with user-weight generated, adjustable, lower back support during seated exercise.

11. The exercise machine of claim 8 wherein the material surface of each said target comprises a resilient surface, and wherein each target comprises an outer ring such that the object thrown against said resilient surface will tend to rebound elastically off said resilent surface.

12. The exercise machine of claim 11 wherein said position-adjustable target is attached to the outer ring such that the object thrown against said resilient surface will tend to rebound elastically off said resilient surface.

13. The exercise machine of claim 12 wherein said target arm connects to the said outer ring in such a manner that said outer ring may be adjusted vertically into or away from to the user of said exercise machine and lock into place where desired by said user.

14. The exercise machine of claim 12 wherein said target arm further connects to said main frame of claim 8 in such a manner that said target arm may rotate horizontally about the vertical axis of said connection to said main frame and lock into place where desired by a user of said machine.

15. The exercise machine of claim 1, further comprising:

a structure, attached to the arm that is attached to the main frame, that attaches to and supports the material surface of the target.

16. The exercise machine of claim 15, wherein the material surface is formed as a resilient material surface that is attached to the structure.

17. The exercise machine of claim 16, wherein the structure is formed to support the edges of the resilient surface.

18. The exercise machine of claim 8, further comprising:

a structure, attached to the arm that is attached to the main frame, that attaches to and supports the material surface of the target.

19. The exercise machine of claim 18, wherein the material surface is formed as a resilient material surface that is attached to the structure.

20. The exercise machine of claim 19, wherein the structure is formed to support the edges of the resilient surface.

* * * * *